US012209852B2

(12) United States Patent
Petropoulos

(10) Patent No.: US 12,209,852 B2
(45) Date of Patent: Jan. 28, 2025

(54) BLASTING SYSTEM AND A METHOD OF EXPLOSIVE MATERIAL CHARGING

(71) Applicant: LUOSSAVAARA-KIIRUNAVAARA AB, Luleå (SE)

(72) Inventor: Nikolaos Petropoulos, Luleå (SE)

(73) Assignee: LUOSSAVAARA-KIIRUNAVAARA AB, Luleå (SE)

( * ) Notice: Subject to any disclaimer, the term of this patent is extended or adjusted under 35 U.S.C. 154(b) by 0 days.

(21) Appl. No.: 18/250,122

(22) PCT Filed: Oct. 20, 2021

(86) PCT No.: PCT/SE2021/051040
§ 371 (c)(1),
(2) Date: Apr. 21, 2023

(87) PCT Pub. No.: WO2022/086411
PCT Pub. Date: Apr. 28, 2022

(65) Prior Publication Data

US 2023/0384074 A1 Nov. 30, 2023

(30) Foreign Application Priority Data

Oct. 22, 2020 (SE) ..... 2051233-1

(51) Int. Cl.
*F42D 1/22* (2006.01)
*F42D 1/10* (2006.01)
*F42D 1/18* (2006.01)

(52) U.S. Cl.
CPC ..... *F42D 1/22* (2013.01); *F42D 1/10* (2013.01); *F42D 1/18* (2013.01)

(58) Field of Classification Search
CPC ..... F42D 1/08; F42D 1/10; F42D 1/20; F42D 1/22; F42D 3/00; F42D 3/04; F42D 1/18; F42B 3/00; E21C 37/12
(Continued)

(56) References Cited

U.S. PATENT DOCUMENTS 473,734 A 4/1892 Forrester
2,536,869 A 1/1951 Bucky
(Continued)

FOREIGN PATENT DOCUMENTS

AU 2036999 A 9/1999
AU 2029402 A 9/2002
(Continued)

OTHER PUBLICATIONS

International Search Report and Written Opinion issued in International PCT Application No. PCT/SE2021/051040 dated Nov. 10, 2021 in 15 pages.
(Continued)

*Primary Examiner* — James S Bergin
(74) *Attorney, Agent, or Firm* — Knobbe, Martens, Olson & Bear, LLP

(57) ABSTRACT

The invention concerns a blasting system (1) configured for explosive material charging in a borehole (3). The system (1) comprises a detonator support device (5) configured to be inserted into the borehole (3) by means of a charging hose (7); a main body (9) of the detonator support device (5) comprises a channel (8) oriented along a main body centre line (CL) extending along the borehole extension during said explosive material charging; an openable cover device (14) covering the channel (8) is configured to come into contact with the charging hose (7) in motion for pushing the main body (9) along the borehole (3), wherein the charging hose (7) in motion is configured to open the openable cover device (14) whilst a stopping arrangement (13) stops the main body (9). The invention also concerns a method of explosive material charging in a borehole (3) by means of the blasting system (1).

15 Claims, 4 Drawing Sheets

(58) Field of Classification Search
USPC ..... 102/313
See application file for complete search history.

(56) References Cited

U.S. PATENT DOCUMENTS

| | | | | |
|---|---|---|---|---|
| 3,438,325 | A | 4/1969 | Martin | |
| 3,615,351 | A | 10/1971 | Happel et al. | |
| 3,635,456 | A | 1/1972 | Anthes et al. | |
| 3,645,717 | A | 2/1972 | Meyer et al. | |
| 3,696,703 | A | 10/1972 | Fox | |
| 3,748,120 | A | 7/1973 | Beggs et al. | |
| 3,779,741 | A | 12/1973 | Celada et al. | |
| 3,939,771 | A | 2/1976 | McReynolds | |
| 4,036,100 | A * | 7/1977 | Hurley | F42D 1/10 166/207 |
| 4,040,329 | A | 8/1977 | Ljungberg | |
| 4,040,330 | A * | 8/1977 | Matzen | F42D 1/10 102/304 |
| 4,060,034 | A | 11/1977 | Bowman et al. | |
| 4,324,390 | A | 4/1982 | Driemeyer | |
| 4,501,199 | A | 2/1985 | Mashimo et al. | |
| 4,522,125 | A | 6/1985 | Marz | |
| 4,581,712 | A | 4/1986 | Perry et al. | |
| 4,592,282 | A | 6/1986 | Niemi et al. | |
| 4,813,358 | A | 3/1989 | Roberts | |
| 4,829,902 | A * | 5/1989 | Sharpe | F42D 1/10 86/20.13 |
| 4,938,536 | A | 7/1990 | Lee | |
| 5,007,683 | A | 4/1991 | Granskog | |
| 5,192,819 | A | 3/1993 | Baumgartner | |
| 5,198,613 | A * | 3/1993 | Jenkins, Jr. | F42B 3/087 102/312 |
| 6,070,511 | A | 6/2000 | Palmer | |
| 6,132,489 | A | 10/2000 | Villarreal-Trevino | |
| 6,395,056 | B1 | 5/2002 | Villarreal-Trevino et al. | |
| 6,397,754 | B1 * | 6/2002 | Perlid | F42D 1/10 86/20.15 |
| 7,175,690 | B2 | 2/2007 | Potter et al. | |
| 8,381,653 | B2 | 2/2013 | Zimmermann | |
| 9,062,953 | B2 | 6/2015 | Leppanen | |
| 9,273,368 | B2 | 3/2016 | Gordon | |
| 10,570,736 | B2 * | 2/2020 | Wang | B25J 9/1697 |
| 2005/0161257 | A1 | 7/2005 | Finden et al. | |
| 2014/0150607 | A1 | 6/2014 | Gordon | |
| 2015/0259760 | A1 | 9/2015 | Eder et al. | |
| 2015/0275323 | A1 | 10/2015 | Hoffman | |
| 2018/0106584 | A1 | 4/2018 | Santos et al. | |
| 2019/0292887 | A1 | 9/2019 | Austin et al. | |
| 2023/0203946 | A1 | 6/2023 | Wagner et al. | |
| 2023/0228193 | A1 | 7/2023 | Wagner et al. | |
| 2023/0392913 | A1 * | 12/2023 | Petropoulos | F42D 1/10 |
| 2023/0400288 | A1 * | 12/2023 | Petropoulos | F42B 3/26 |
| 2024/0124948 | A1 | 4/2024 | Eriksson et al. | |
| 2024/0279766 | A1 | 8/2024 | Sandberg et al. | |

FOREIGN PATENT DOCUMENTS

| | | | |
|---|---|---|---|
| AU | 766127 | B2 | 10/2003 |
| CA | 703542 | A | 2/1965 |
| CA | 3176355 | A1 | 11/2021 |
| CN | 203837589 | U | 9/2014 |
| CN | 108374067 | A | 8/2018 |
| CN | 106894817 | | 11/2018 |
| CN | 110644997 | | 1/2020 |
| CN | 210293005 | U | 4/2020 |
| DE | 2106062 | A1 | 8/1971 |
| EP | 0018235 | A1 | 10/1980 |
| EP | 3222953 | A1 | 9/2017 |
| GB | 2532689 | A | 5/2016 |
| JP | 2006/002193 | A | 1/2006 |
| JP | 2012102371 | A | 5/2012 |
| KR | 20100039491 | A | 4/2010 |
| RU | 2706994 | C1 | 11/2019 |
| SE | 465566 | B | 9/1991 |
| SE | 2150180 | A1 | 8/2022 |
| SU | 262127 | A1 | 12/1977 |
| WO | WO 1995/030068 | A1 | 11/1995 |
| WO | WO 1998/41811 | A1 | 9/1998 |
| WO | WO 2001/004563 | A1 | 1/2001 |
| WO | WO 2008/148544 | A1 | 12/2008 |
| WO | WO 2011/038449 | A1 | 4/2011 |
| WO | WO 2011/100808 | A1 | 8/2011 |
| WO | WO 2011/117394 | A1 | 9/2011 |
| WO | WO 2014/109755 | A1 | 7/2014 |
| WO | WO 2017/214422 | A1 | 12/2017 |
| WO | WO 2020/039332 | A1 | 2/2020 |
| WO | WO 2021/183022 | A1 | 9/2021 |
| WO | WO 2021/241272 | A1 | 12/2021 |

OTHER PUBLICATIONS

International Preliminary Report on Patentability for PCT/SE2021/051040 dated Nov. 24, 2022 in 16 pages.
First Notice and Search Report for SE2051233-1 dated May 11, 2021 in 8 pages.
Second Notice for SE2051233-1 dated Nov. 8, 2021 in 4 pages.
Written Opinion of the International Preliminary Examining Authority issued in International Application No. PCT/SE2021/051040 dated Jul. 8, 2022 in 4 pages.
Atlas Copco: "Mining methods in underground mining", Second Edition, Dec. 31, 2007, Retrieved from the Internet: URL :https://batavia.internal.epo.org/citenpl/prod/web/citenpl/citenpl.html [Uploaded in 2 parts].
Bhaskar et al., "Decarbonization of the Iron and Steel Industry with Direct Reduction of Iron Ore with Green Hydrogen", Energies, 2020, 13, 758, in 23 pages.
Hudyma et al., "Monitoring open stope caving at Goldex Mine", Proceedings of the Second International Symposium On Block and Sublevel Caving, Dec. 31, 2010, pp. 133-144.
International Search Report and Written Opinion in International Application No. PCT/SE2021/050475 dated Jun. 23, 2021 in 13 pages.
International Preliminary Report on Patentability in International Application No. PCT/SE2021/050475 dated Apr. 22, 2022 in 6 pages.v.
Notice (4 months) in Swedish Patent Application No. 2130072-8 dated Jun. 22, 2021 in 4 pages.
Final Notice (2 months) in Swedish Patent Application No. 2130072-8 dated Feb. 22, 2022 in 4 pages.
Swedish Search Report in Swedish Patent Application No. 2130072-8 dated Jun. 22, 2021 in 2 pages.
Notification of Transmittal of International Preliminary Report on Patentability for PCT/SE2021/051042 dated Nov. 24, 2022.
International Search Report and Written Opinion of the International Searching Authority for PCT/SE2021/051042 dated Nov. 1, 2021.
First Notice in Swedish Patent Application No. 2051234-9 dated May 5, 2021 in 9 pages.
Second Notice in Swedish Patent Application No. 2051234-9 dated Oct. 29, 2021 in 4 pages.
Third Notice in Swedish Patent Application No. 2051234-9 dated Jul. 7, 2022 in 4 pages.
Final Notice in Swedish Patent Application No. 2051234-9 dated Dec. 14, 2022 in 34 pages.
Third Notice for in Swedish Patent Application No. SE2051233-1 dated Mar. 31, 2023 in 4 pages.
International Search Report / Written Opinion of International Searching Authority for PCT/SE2021/051036 dated Nov. 1, 2021 in 11 pages.
International Preliminary Report on Patentability for PCT/SE2021/051036 dated Nov. 17, 2022 in 30 pages.
First Notice and Search Report in Swedish Patent Application No. SE2051232-3 dated May 5, 2021 in 12 pages.
Second Notice in Swedish Patent Application No. SE2051232-3 dated Oct. 29, 2021 in 4 pages.
Third Notice in Swedish Patent Application No. 2051232-3 dated Jul. 15, 2022 in 6 pages.

(56) References Cited

OTHER PUBLICATIONS

International Preliminary Report on Patentability in International Application No. PCT/SE2021/050477 dated Apr. 22, 2022 in 6 pages.
International Search Report in International Application No. PCT/SE2021/050477 dated Jun. 23, 2021 in 10 pages.
Notice (4 Months) in Swedish Patent Application No. 2150606-8 dated Jun. 22, 2021 in 5 pages.
Final Notice (2 Months) in Swedish Patent Application No. 2150606-8 dated Feb. 22, 2022 in 4 pages.
Swedish Search Report in Swedish Patent Application No. 2150606-8 dated Jun. 22, 2021 in 2 pages.
Eurasian Office Action in Eurasian Application No. 202293280 dated Apr. 5, 2023 in 5 pages.
Eurasian Office Action in Eurasian Application No. 202293281 dated Apr. 7, 2023 in 5 pages.
Eurasian Office Action in Eurasian Application No. 202391192 dated Sep. 12, 2023.
Notice and Search Report for SE 2150180-4 dated Oct. 14, 2021 in 11 pages.
Notice and Search Report for SE 2150180-4 dated May 31, 2023 in 5 pages.
International Preliminary Report on Patentability for PCT/SE2022/050182 dated dated Feb. 8, 2023 in 35 pages.
International Search Report and Written Opinion of the International Searching Authority for PCT/SE2022/050182 dated May 20, 2022 in 16 pages.
International Search Report and Written Opinion issued in International Application No. PCT/SE2022/050557 dated Jun. 16, 2022 in 14 pages.
Office Action issued in Swedish Application No. 2150736-3 dated Jul. 1, 2022 in 4 pages.
Office Action issued in Swedish Application No. 2150736-3 dated Mar. 1, 2022 in 8 pages.
International Preliminary Report on Patentability for PCT/SE2022/050557 dated Apr. 20, 2023 in 14 pages.
Communication pursuant to Rule 114(2) EPC issued in EP Application No. 22756641.1, dated Feb. 22, 2024.
Extended European Search Report issued in European Patent Application No. 21809335.9 dated Jun. 25, 2024 in 16 pages.
Extended European Search Report issued in European Patent Application No. 21808020.8 dated Jul. 2, 2024 in 15 pages.
Search and Expert Report issued in Chilean Application No. 202301147 dated Aug. 20, 2024 in 42 pages.
International Search Report and Written Opinion issued in International Application No. PCT/SE2022/051197, mailed on Jan. 23, 2023.
Search Report issued in Swedish Application No. 2151619-0, dated Aug. 26, 2022.
International Search Report and Written Opinion received in International Application No. PCT/SE2023/050293, mailed Jun. 14, 2023.
Swedish Office Action received in Swedish Application No. 2250421-1, dated Dec. 1, 2022, in 9 pages.
International Search Report and Written Opinion received in International Application No. PCT/SE2023/050298, mailed Jun. 7, 2023.
Swedish Office Action received in Swedish Application No. 2250422-9, dated Dec. 1, 2022, in 9 pages.
Second Swedish Office Action received in Swedish Application No. 2250422-9, dated Apr. 4, 2024, in 4 pages.

* cited by examiner

BLASTING SYSTEM AND A METHOD OF EXPLOSIVE MATERIAL CHARGING

TECHNICAL FIELD

The present invention relates to a blasting system according to claim 1 and to a method of explosive material charging according to claim 8.

The present invention primary concerns the mining industry making use of blasting systems and detonator support devices and using methods of explosive material charging.

The present invention also concerns the industry manufacturing detonator support devices and of blasting systems.

BACKGROUND

In underground mines, water may appear in the drilled borehole. This water originates either from drilling or groundwater. In such environment, a borehole wall of the drilled borehole may have a film of water, or may even be filled with water. Such a wet borehole involves that the explosive material would not have enough adhesion with the borehole wall due to the film of water. Due to the poor adhesion, the explosive material may flow out of the borehole and splashes onto the crosscut floor of the mine. The consequences of owed the splashes are many, e.g. dangerous working environment due to explosive material covering the entire crosscut floor, nitrogen contamination and other chemical contamination of the ground water, adversely affected water pumps with explosive material, etc.

In blasting operations making use of blasting systems, at least one borehole being drilled in the rock and the explosive material is charged into the borehole by means of a charging hose. The explosive material in the borehole is initiated by means of a detonator unit arranged in a detonator support device, wherein the explosive material is initiated into detonation causing fragmentation of the rock.

Current blasting systems and methods of explosive material charging used in the mining industry for charging explosive material into wet boreholes may use different types of plugs or cartridges for holding the explosive material in the wet borehole.

However, prior art blasting systems are time consuming to use in wet boreholes. The prior art plugs and cartridges are pushed out from the wet borehole due to high water pressure building up in the borehole above the plug or cartridge. The high water pressure thus affects the plug or cartridge from above together with the weight of the explosive material.

The borehole generally has a vertical direction. However, the borehole may have different directions, such as generally horizontal or oblique directions.

SUMMARY OF THE INVENTION

There is an object to provide a blasting system configured for explosive material charging in a wet borehole.

There is an object to provide a blasting system that is easy and secure to handle and that at the same time provides sustainable initiating of the explosive material.

There is an object to provide a blasting system that safely keeps or holds the explosive material in the borehole.

There is an object to provide a blasting system that is cost-effective and time-saving to use.

There is an object to provide a blasting system that is flexible and adjustable for different types of boreholes and for different lengths of boreholes.

There is an object to provide a blasting system that is of light weight.

There is an object to provide a light-weight detonator support device of a blasting system.

There is an object to provide a blasting system that can be applied by a charging truck also used for charging explosive material in dry boreholes.

There is an object to provide a blasting system that promotes secure blasting and initiating of the explosive material.

There is an object to provide a compact detonator support device of a blasting system.

There is an object to provide a detonator support device of a blasting system that can be put into use in a flexible blasting system configured to be charged in a borehole of a mine.

There is an object to provide a detonator support device of a blasting system that can be used for different blasting charge applications and systems in a borehole.

This or at least one of said objects has been achieved by a blasting system configured for explosive material charging in a borehole, the system comprises; a detonator support device configured to be inserted into the borehole by means of a charging hose; a main body of the detonator support device comprises a channel oriented along a main body centre line (CL) extending along the borehole extension during said explosive material charging; an openable cover device covering the channel is configured to come into contact with the charging hose in motion for pushing the main body along the borehole, wherein the charging hose in motion is configured to open the openable cover device whilst a stopping arrangement stops the main body.

Alternatively, the openable cover device is configured to be opened by the free end of a charging hose nozzle of the charging hose being in motion whilst the main body is configured to be stopped at a pre-determined distance from the borehole entrance.

Alternatively, a charging hose nozzle of the charging hose is configured for said pushing of the main body and configured to open the openable cover device by further motion of the charging hose through the opening thus opening the openable cover device.

Alternatively, the charging hose nozzle is configured to discharge an explosive material into the borehole after opening of the openable cover device.

Alternatively, the borehole generally extends vertically.

Alternatively, the borehole generally may extend oblique or horizontally.

Alternatively, the borehole comprises a borehole entrance and a borehole bottom.

Alternatively, the main body comprises a first end facing the borehole entrance during said explosive material charging and comprises a second end facing the borehole bottom, when the main body is in position in the borehole.

Alternatively, the charging hose is moved by an electrical motor of a mining truck.

Alternatively, the charging hose is configured to split or break a splitable cover member of the openable cover device by said motion of the charging hose whilst the stopping arrangement stops the main body.

Alternatively, the charging hose nozzle of the charging hose is configured to split or break the openable cover device.

Alternatively, the openable cover device comprises a backflow prevention valve device configured to prevent discharged explosive material discharged from the charging hose to flow back into and/or passing through the channel when the charging hose has been removed from the opening.

Alternatively, a detonator unit compartment is provided in the main body adjacent the channel and configured to support a detonator unit.

Alternatively, the detonator unit compartment exhibits a prolongation extending parallel with the prolongation of said channel and is provided adjacent the channel and exhibits an compartment opening facing the borehole bottom during said explosive material charging, Alternatively, the detonator unit is carried by the detonator unit compartment by means of gravity.

Alternatively, a detonation cord member, such as a shock tube or detonation cord, is coupled to the detonator unit and runs from the detonator unit positioned in the detonator unit compartment passing the main body exterior toward the borehole entrance.

Alternatively, the main body comprises a resilient member extending circumferentially around the main body and arranged to an outer peripheral surface of the main body and around the main body centre axis.

Alternatively, the resilient member runs around the main body in the peripheral direction coaxially with the main body centre axis.

Alternatively, the resilient member runs discontinuously around the main body.

Alternatively, the resilient member is made of flexible resilient material and is adapted to engage the borehole wall of the borehole and/or biased into secure engagement with the borehole wall.

Alternatively, the resilient member is tooth shaped with open spaces there between.

Alternatively, the resilient member comprises at least one open space configured to permit passage of water flowing along the borehole wall.

In such way is achieved that water is permitted to pass the exterior of the main body and between the borehole wall and the outer peripheral surface of the main body, thus passing through the at least one open space.

In such way is avoided that water pressure is built up above the main body, which water pressure otherwise may press out the main body from the borehole releasing the explosive material from the borehole.

Alternatively, the resilient member exhibits tooth shaped flaps, each having a sloping outward extension relative the main body centre line of 30-70 degrees, preferably 45-60 degrees, and declining toward the first end.

Alternatively, a net member or other suitable filter member is arranged covering the open space of the resilient member.

In such a way is achieved that gravel and sand, but primarily water passes through the resilient member.

Alternatively, the resilient member allows resilient deformation of the resilient member upon insertion of the main body into the borehole, thereby engaging the borehole wall.

In such way is secure engagement achieved between the main body and the borehole wall.

Alternatively, the at least one resilient member extends circumferentially around the main body and is arranged to an outer peripheral surface of the main body and around the main body centre axis.

Alternatively, the resilient member extends continuously around the main body.

Alternatively, the resilient member is adapted to sealingly engage the borehole wall, thus biasing toward the borehole wall for holding the detonator support device in position in the borehole.

Alternatively, an upper part of the detonator supports comprises a protrusion or a depression and a lower part of the detonator supports comprises a depression or a protrusion, which depression and protrusion mate with each other for joining adjacent detonator supports to each other.

Alternatively, the openable cover device comprises a backflow prevention valve device arranged at the first end of the main body and a splitable cover member arranged at the second end of the main body.

In such way, for an oblique or vertical borehole and for a borehole bottom that is above a borehole entrance, the channel will be filled with the explosive material that has been charged into the borehole above the main body, by that the explosive material streams downward due to gravity through the opened splitable cover member and further downward into the channel and the explosive material is obstructed by the backflow prevention valve to flow beyond the channel.

By collecting the explosive material also in the channel, the detonator unit positioned in the detonator unit compartment adjacent the channel will come close to the explosive material promoting secure blasting.

Alternatively, the stopping arrangement is arranged between the main body and the borehole entrance at a predetermined distance.

Alternatively, the stopping arrangement comprises a line arrangement running from the main body to a stop configured to abut the edge of the borehole entrance.

Alternatively, the stop exhibits a dimension larger than the diameter of the borehole and may comprise a rod obstructed to pass the borehole entrance.

Alternatively, the line arrangement may comprise two lines running parallel from the main body to the rod.

Alternatively, the rod is positioned transversely over the borehole entrance.

In such way is achieved that the main body can be positioned at a predetermined position in the borehole above the borehole entrance.

Alternatively, the main body comprises a circumferential wall extending along the prolongation of the main body centre line.

Alternatively, a lower portion of the main body comprises the first end and an upper portion of the main body comprises the second end.

Alternatively, the lower portion comprises a first end wall having an extension perpendicular to the main body centre line.

Alternatively, the upper portion comprises a second end wall having an extension perpendicular to the main body centre line.

Alternatively, a breakable wall portion of the splitable cover member is formed in a section of the second end wall of the main body.

Alternatively, the breakable wall portion of the splitable cover member exhibits a structure of such high strength that a front end of the charging hose nozzle of the charging hose does not break the breakable wall portion during said pushing, however the structure of the breakable wall portion is of such strength that the front end of the charging hose nozzle breaks the breakable wall portion when the main body is stopped by the stopping arrangement and the charging hose is in motion.

Alternatively, the motion of the charging hose is stopped when the charging hose nozzle has passed the breakable wall portion.

Alternatively, the charging hose nozzle is configured to discharge the explosive material into the borehole extending above the main body, after breaking the breakable wall portion of the splitable cover member by means of the charging hose nozzle.

Alternatively, the charging hose nozzle of the charging hose is withdrawn from the breakable wall portion of the splitable cover member and further withdrawn from the backflow prevention valve, thus moving the charging hose downward.

Alternatively, the backflow prevention valve is configured to provide a closing of a flap member of the backflow prevention valve subsequently the charging hose nozzle has been withdrawn from the backflow prevention valve.

Alternatively, the backflow prevention valve comprises a flap valve.

Alternatively, the flap valve is spring biased for providing said closing preventing the explosive material above the backflow prevention valve to stream further downward.

Alternatively, the flap valve is hingedly coupled to a channel wall of the channel and is openable in a direction toward the second end of the main body.

Alternatively, the engagement force of the resilient flanges generates sufficient friction resisting motion of the main body relative the borehole, which motion otherwise would prevail due to gravity and pressure of explosive material and water pressure, and thus holding the explosive material in the borehole at the same time as the water can flow through the open spaces of the resilient member.

This or at least one of said objects has been achieved by a detonator support device configured for supporting a detonator unit and configured for explosive material charging in a borehole, the detonator support device comprises a main body having a channel oriented along a main body centre line and comprises an openable cover device covering the channel, which openable cover device is configured to come into contact with a charging hose in motion for the pushing of the main body and the opening of the openable cover in accordance with claim 1.

This or at least one of said objects has been achieved by a method of explosive material charging in a borehole by means of a blasting system comprising; a detonator support device configured to be inserted into the borehole by means of a charging hose; a main body of the detonator support device comprises a channel oriented along a main body centre line extending along the borehole extension during said explosive material charging; an openable cover device covering the channel is configured to come into contact with the charging hose in motion for pushing the main body along the borehole, wherein the charging hose in motion is configured to open the openable cover device whilst a stopping arrangement stops the main body; wherein the method comprises the steps of: providing the detonator support device coupled to the stopping arrangement; preparing a detonator unit to be coupled to a detonation cord member; mounting the detonator unit to the detonator support device; inserting the detonator support device into the borehole; pushing the detonator support device by the charging hose; stopping the detonator support device by means of the stopping arrangement; opening the openable cover device by further motion of the charging hose; charging the explosive material into the borehole; and removing the charging hose.

Alternatively, the openable cover device in said opening step is configured to split or break by means of a charging hose nozzle of the charging hose in motion.

Alternatively, the step of removing the charging hose comprises withdrawing of the charging hose from the openable cover device.

Alternatively, the step of pushing the detonator support device is preceded by that the charging hose enters and pass a backflow prevention valve and subsequently abuts a splitable cover member of the openable cover device for providing said pushing.

Alternatively, the step of stopping the detonator support device and the step of opening the openable cover device being performed simultaneously, wherein the a splitable cover member splits or breaks by the charging hose.

Alternatively, the method comprises a step defined as stop moving the charging hose.

Alternatively, the method comprises a step defined as discharging of explosive material from the charging hose nozzle into the borehole above the main body of the detonator support.

Alternatively, the method comprises a step defined as stopping the discharge of explosive material.

Alternatively, the method comprises a step defined as withdrawal of the charging hose from the borehole.

Alternatively, the method comprises a step defined as stopping the method.

A borehole may be defined as a wet borehole having a borehole wall that is partly or fully is covered by a water film. The thickness of the water film may be 0, 1-1, 1 mm or larger.

The water film may originate from the drilling of the borehole (added water or other cooling fluid for cooling the bore) or groundwater.

The water film may comprise also any type of cooling fluid for cooling the drill.

This or at least one of said objects has been achieved by an autonomous or semi-automatic explosive material charging vehicle.

This or at least one of said objects has been achieved by a data medium and a data medium product.

BRIEF DESCRIPTION OF THE DRAWINGS

The present invention will now be described by way of examples with references to the accompanying schematic drawings, of which.

DETAILED DESCRIPTION

Hereinafter, exemplary embodiments of the present invention will be described with reference to the accompanying drawings, wherein for the sake of clarity and understanding of the invention some details of no importance may be deleted from the drawings.

Figure 1A:
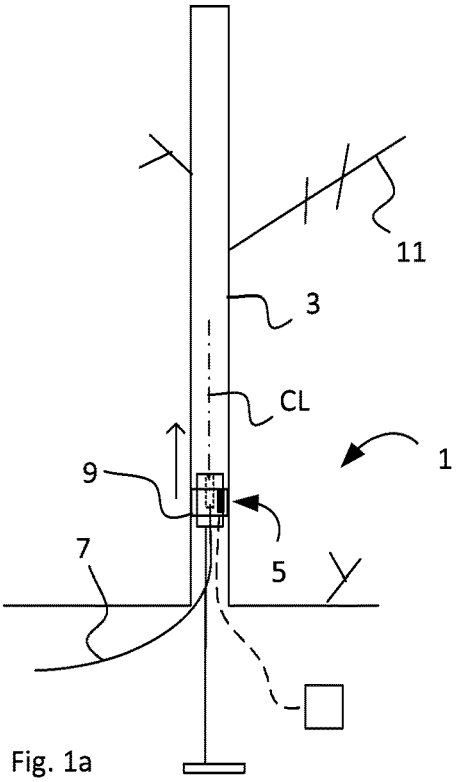
FIGS. 1*a*-1*d* illustrate a blasting system according to a first example.
Figure 1B:
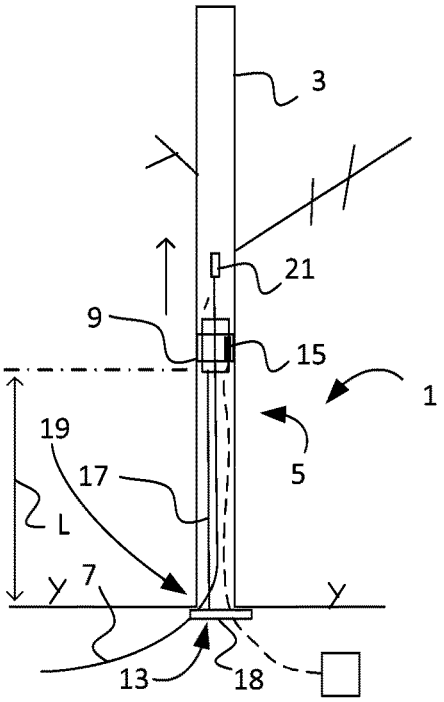
Figure 1C:
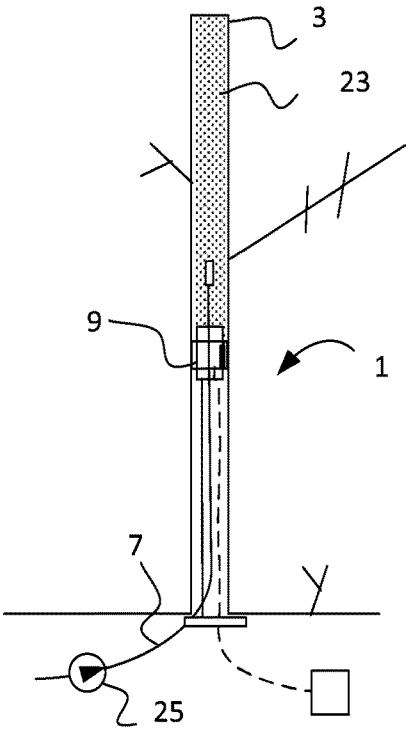
Figure 1D:
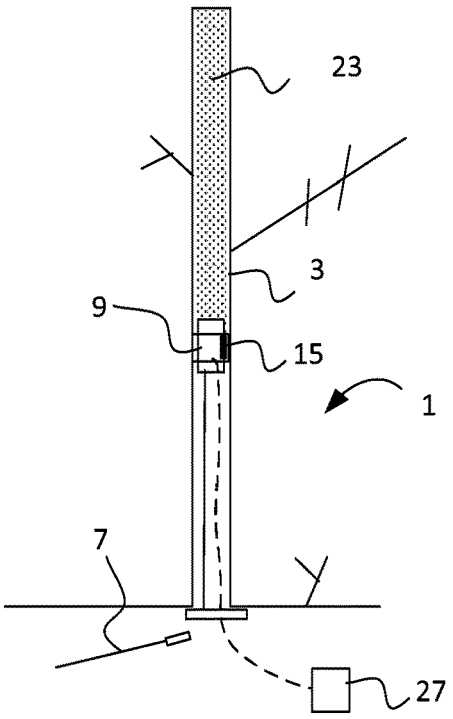

FIGS. 1*a*-1*d* illustrate a blasting system 1 according to a first example configured for explosive material charging in a borehole 3. The blasting system 1 comprises a detonator support 5 configured to be inserted into the borehole 3 by means of a charging hose 7. A main body 9 of the detonator support 5 comprises a channel (not shown) oriented along a main body centre line CL extending along the borehole extension during said explosive material charging. A crack 11 in the rock feeds ground water to the borehole 3. An openable cover (not shown) covering the channel is configured to come into contact with the charging hose 7 in motion for pushing the main body 9 along the borehole 3. The charging hose 7 in motion is configured to open the openable cover device whilst a stopping arrangement 13 stops the main body 9 as shown in FIG. 1*b*. A detonator unit compartment (not shown) is provided in the main body 9 adjacent the channel and is configured to support a detonator unit 15. The stopping arrangement 13 has a line assembly 17 arranged between the main body 9 and a stop rod 18 configured to abut the borehole entrance 19. An operator (not shown) can thus easily set the length of the line assembly 17 corresponding with the length L of the uncharged part of the borehole 3 based on a charging plan. The operator simply may make a knot at the line assembly 17 for proving proper length L. Preferably, the stop rod 18 (such as a timber stick) may be 2-4 times longer than the diameter of the borehole 3. A charging hose nozzle 21 of the charging hose 7 discharges the explosive material 23 into the borehole 3 above the main body 9 by pumping the explosive material 23 by means of a pump 25. Also the channel (not shown) of the main body 9 will be filled with the explosive material 23 that has been charged into the borehole above the main body 9, as seen in FIG. 1*c*, by that the explosive material streams downward due to gravity through the opened openable cover (not shown) and further downward into the channel of the main body 9. The explosive material 23 is obstructed to flow beyond the channel by means of a backflow prevention valve (not shown). In FIG. 1*d* is shown that the charging hose 7 fully has been withdrawn from the borehole 3 and the main. body 9 of the blasting system 1 holds the explosive material 23 above the main body 9 and in contact with the detonator unit 5. The detonator unit 15 is connected to a controller 27.

Figure 2:
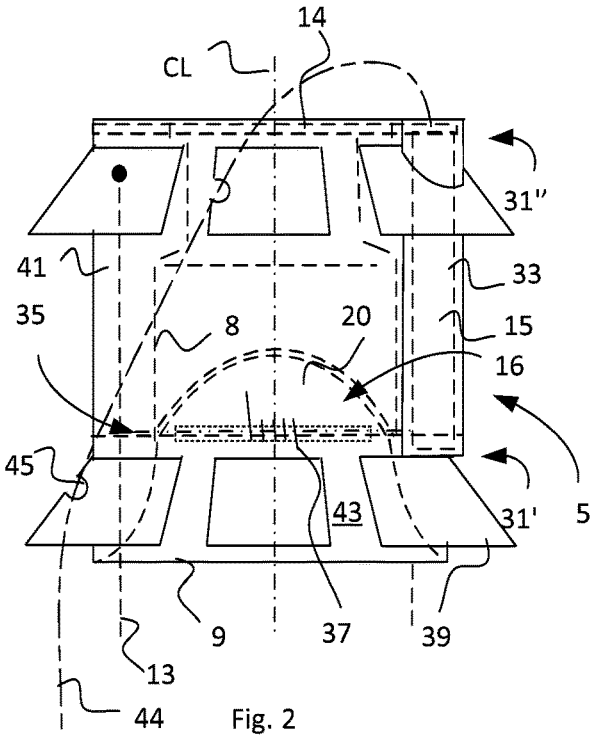
FIG. 2 illustrates in a side view a detonator support device of a blasting system according to a second example.

FIG. 2 illustrates in a side view a detonator support 5 of a blasting system according to a second example. A main body 9 of the blasting system comprise a detonator support 5 configured to be inserted into a borehole (not shown) by means of a charging hose (not shown). The main body 9 of the detonator support 5 comprises a channel 8 oriented along a main body centre line CL extending along the borehole extension during said explosive material charging. A splitable cover 14 covering the channel 8 is configured to come into contact with the charging hose in motion for pushing the main body 9 along the borehole.

Alternatively, a backflow prevention valve 16 is positioned at a first end 31' of the main body 9 and is curved so that a valve flap 20 in opened position extends along the curvature of the channel 8, which implies that the charging hose can fill out the space optimally within the channel 8, thus providing a compact detonator support 5.

The charging hose in motion is configured to open the splitable cover 14 of an upper opening at a second end 31" of the main body 9, whilst a stopping arrangement 13 stops the main body (as shown in FIG. 1*b*). A detonator unit compartment 33 is provided in the main body 9 adjacent the channel 8 and is configured to support a detonator unit 15.

The backflow prevention valve 16 is configured to prevent discharged explosive material (not shown), discharged from the charging hose, to pass the channel 8 and below the channel when the charging hose has been removed from the upper opening 10 and removed from the backflow prevention valve 16.

The backflow prevention valve 16 is hingedly arranged about a hinge 35 and is spring biased to a closed state by means of a spring 37.

The main body 9 comprises a plurality of resilient flanges 39 extending circumferentially around the main body 9 and is arranged to an outer peripheral surface 41 of the main body 9 and around the main body centre axis CL. The resilient flanges 39 extend discontinuously around the main body 9 and is adapted to engage the borehole wall of the borehole and biased into secure engagement with the borehole wall. The resilient flanges 39 are made of flexible material and is tooth shaped with open spaces 43 there between.

In such way is achieved that water is permitted to pass the exterior of the main body 9, thus between the borehole wall and the outer peripheral surface 41 of the main body 9 and passing through the open spaces 43. In such way is avoided that high water pressure is built up above the main body 9, which water pressure otherwise would press out the main body 9 from the borehole and releasing the explosive material from the borehole to the crosscut floor (not shown). The blasting system thus allows ground water and remaining drill cooling water to drain by the provision that the main body 9 does not completely seal the borehole.

The upper part of the main body may have thinner wall than the lower part of the main body 9 to increase the structural strength of the main body 9 and to optimise the design of the splitable cover 14 of the upper opening of the second end 31".

The tooth shaped resilient flanges 39 may be formed as anchoring wings having notches 45 configured to guide and protect a shock tube 44 and/or a detonation cord 44 running from the detonator unit 15 and through the borehole into the crosscut.

Figure 3:
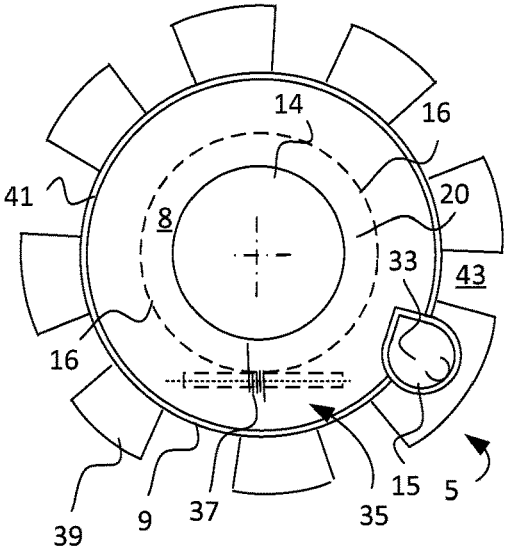
FIG. 3 illustrates from above a detonator support device of a blasting system according to a third example.

FIG. 3 illustrates from above a detonator support 5 of a blasting system according to a third example. A main body 9 comprises a channel 8 oriented along the main body centre line. A backflow prevention valve flap 20 of a non-return valve 16 positioned at a first end of the main body 9. The backflow prevention valve flap 20 is spring based into closed position by means of a spring 37.

Alternatively, a charging hose (not shown) in motion is configured to open the backflow prevention valve flap 20 and subsequently open a splitable cover 14 at a second end of the main body 9, whilst a stopping arrangement (not shown) stops the main body 9 (as shown in FIG. 1*b*) to be pushed further, whereas a charging hose nozzle (not shown)

of the charging hose penetrates and breaks the splitable cover 14 to directly face the borehole (above the main body 9) to be filled with explosive material.

A detonator unit compartment 33 is provided in the main body 9 adjacent the channel 8 and is configured to support a detonator unit 15.

The main body 9 comprises resilient flanges 39 extending circumferentially around the main body 9 and is arranged to an outer peripheral surface 41 of the main body 9 and around the main body centre axis. The resilient flanges 39 extend discontinuously around the main body 9 and is adapted to engage the borehole wall of the borehole and biased into secure engagement with the borehole wall. The resilient flanges are made of flexible material and is tooth shaped with open spaces 43 there between.

Figure 4:
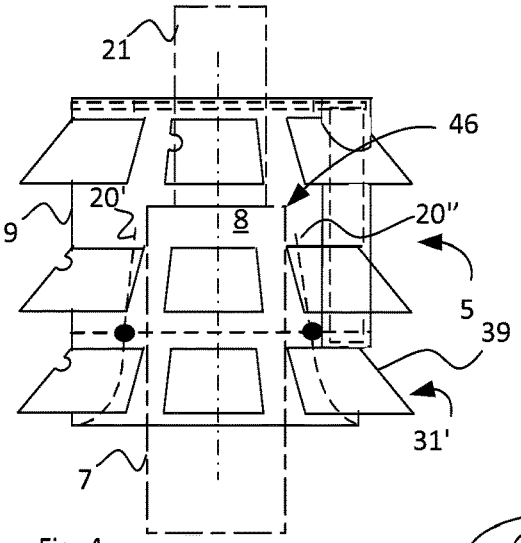
FIG. 4 illustrates in a side view a detonator support device of a blasting system according to a fourth example.

FIG. 4 illustrates in a side view a detonator support 5 of a blasting system according to a fourth example. A main body 9 of the detonator support comprises a resilient flange arrangement having three rows of teeth. This example uses a backflow prevention valve divided in two closable flaps 20', 20". In FIG. 4 is shown a position being settled for explosive material discharge from a charging hose nozzle 21 of a charging hose 7. An upper portion 46 of the charging hose 7 is accommodated in the channel 8 of the main body 9. The resilient flanges formed as teeth exhibit sloping outward extension relative the main body centre line of 30-70 degrees, preferably 45-60 degrees, and declining toward the first end 31' of the main body 9.

Figure 5:
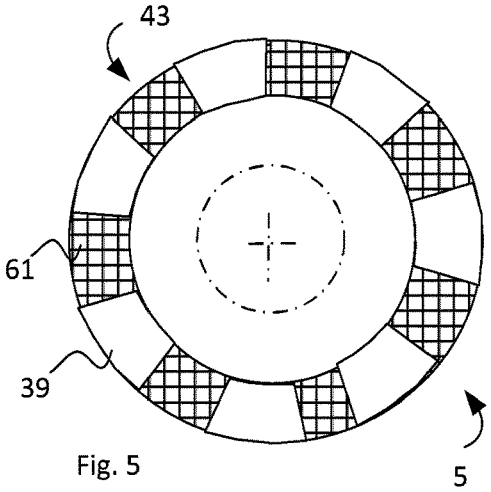
FIG. 5 illustrates from above a detonator support device of a blasting system according to a fifth example.

FIG. 5 illustrates from above a detonator support 5 of a blasting system according to a fifth example. A set of nets 61 or other suitable filters have been arranged in the open spaces 43 of the resilient flanges 39 for capturing gravel, sand and other particles from falling down to the crosscut floor. Primarily, the water passes through the open spaces 43 of the resilient flanges 39.

Figure 6:
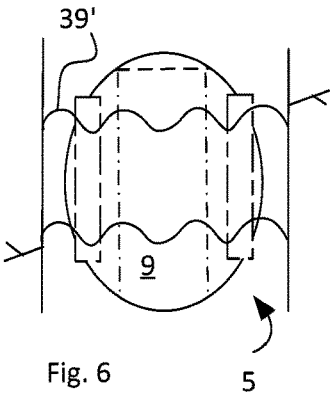
FIG. 6 illustrates in a side view a detonator support device of a blasting system according to a sixth example.

FIG. 6 illustrates in a side view a detonator support 5 of a blasting system according to a sixth example. A main body 9 of the detonator support 5 comprises an upper and lower wave-shaped flexible rubber braid or rim 39', which are configured to engage the borehole wall. A channel 8 of the main body 9 is formed to receive a charging hose nozzle. A pair of tubes are provided to be adjacent the borehole wall for the release of the water pressure in the charged borehole. Alternatively, the braid or rim 39' may have holes.

Figure 7:
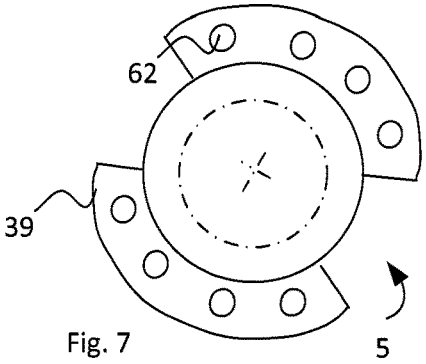
FIG. 7 illustrates from above a detonator support device of a blasting system according to a seventh example.

FIG. 7 illustrates from above a detonator support 5 of a blasting system according to a seventh example. The detonator support 5 has two elastic flanges 39 with a plurality of holes 62 arranged for decreasing the water pressure.

Figure 8:
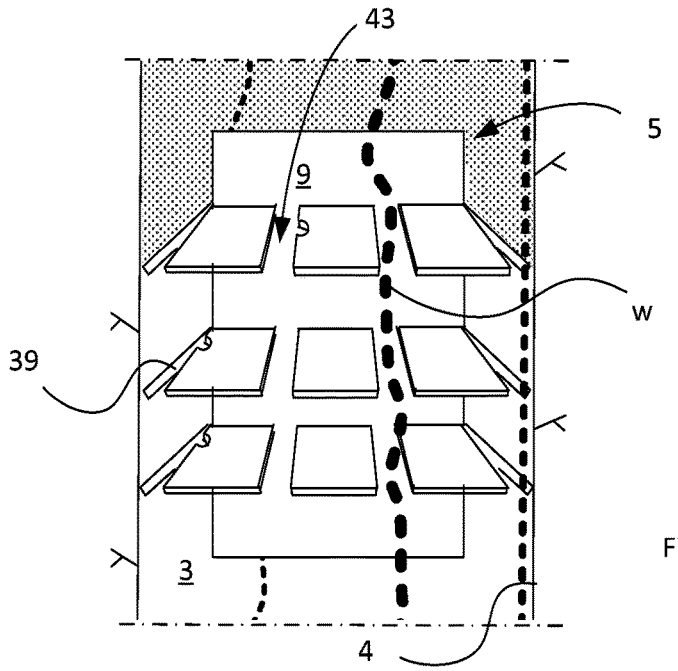
FIG. 8 illustrates in a side view a detonator support device of a blasting system according to an eight example.

FIG. 8 illustrates in a side view a detonator support 5 of a blasting system according to an eight example. FIG. 8 shows water w flowing along the borehole wall 4 of the borehole 3. As shown, the main body 9 is engaged to the borehole wall 4 by means of the resilient flanges 39 being in contact with the borehole wall 4. The engagement force of the resilient flanges 39 generates sufficient friction resisting motion of the main body 9 relative the borehole, which motion otherwise would prevail due to gravity and pressure of explosive material 23 and water pressure, and thus holding the explosive material 23 in the borehole 3 at the same time as the water can flow through the open spaces 43 of the resilient flanges.

Figure 9A:
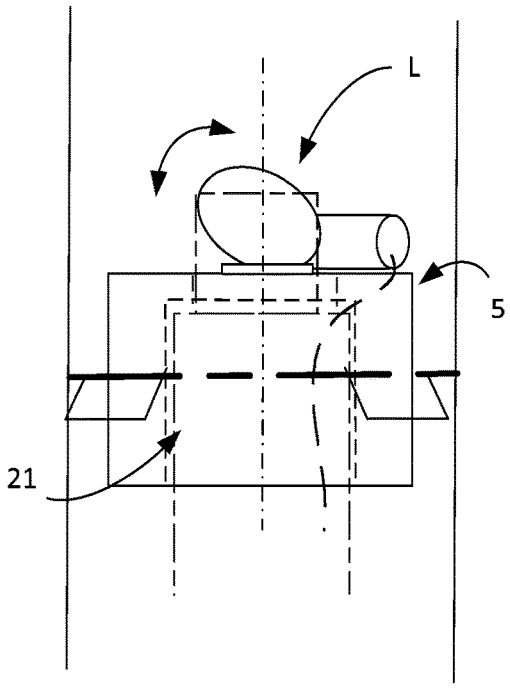
FIGS. 9*a*-9*b* illustrate in a side view a detonator support device of a blasting system according to a ninth example.
Figure 9B:
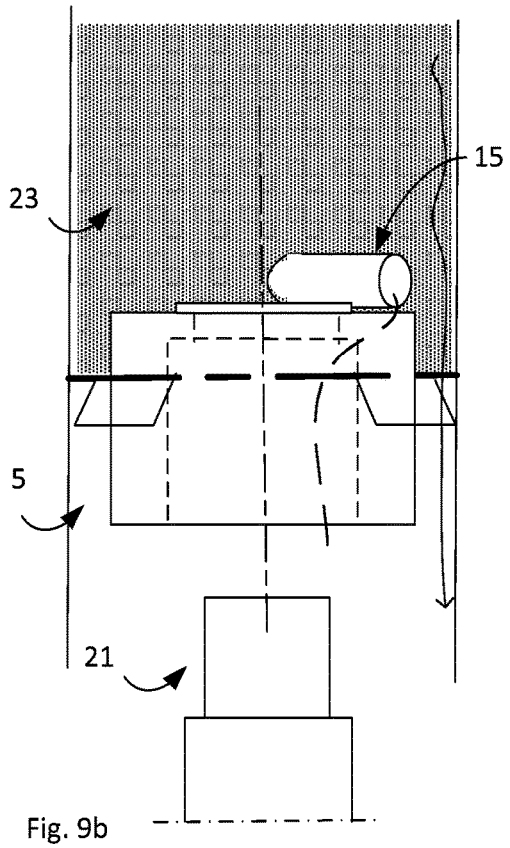

FIGS. 9*a*-9*b* illustrate in a side view a detonator support 5 of a blasting system according to a ninth example. As shown in FIG. 9*a*, the charging hose nozzle 21 has pushed the main body upward in the bore hole by that the free end of the nozzle abuts an openable lid L. The openable lid L is closable by means of a biasing force of enough amount to permit said pushing. When the line arrangement stops the motion of the main body, the nozzle opens the lid L. A detonator unit 15 is positioned on an upper side of the main body so that good contact between the detonator unit and the explosive material is achieved. A shown in FIG. 9*b*, the charging hose nozzle has been removed and the openable lid L has closed by means of said biasing force and the explosive material 23 is obstructed to flow downward.

Figure 10:
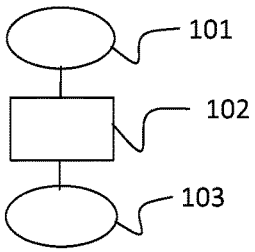
FIG. 10 illustrates a flowchart showing an exemplary method of explosive material charging in a borehole.

FIG. 10 illustrates a flowchart showing an exemplary method of explosive material charging in a borehole by means of a blasting system 1. The blasting system comprises a detonator support configured to be inserted into the borehole by means of a charging hose. A main body of the detonator support comprises a channel oriented along a main body centre line extending along the borehole extension during said explosive material charging. An openable cover covering the channel is configured to come into contact with the charging hose in motion for pushing the main body along the borehole. The charging hose in motion is configured to open the openable cover device whilst a stopping arrangement stops the main body as e.g. shown in FIG. 1*b*.

The method comprises a first step 101 starting the method. A second step 102 shows the performance of the method. A third step 103 comprises stopping the method.

The second step 102 may comprise; providing the detonator support device coupled to the stopping arrangement; preparing a detonator unit to be coupled to a detonation cord member; mounting the detonator unit to the detonator support device; inserting the detonator support device into the borehole; pushing the detonator support device by the charging hose; stopping the detonator support device by means of the stopping arrangement; opening the openable cover device by further motion of the charging hose; charging the explosive material into the borehole; and removing the charging hose.

Figure 11:
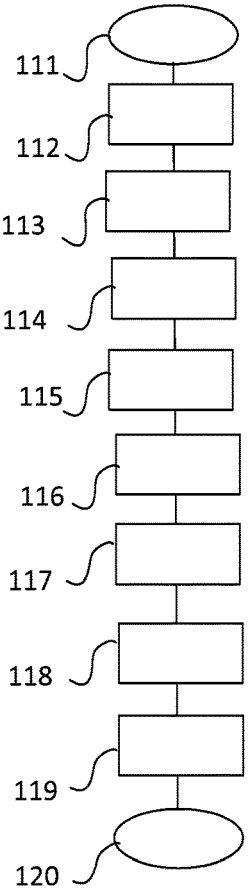
FIG. 11 illustrates a flowchart showing an exemplary method of explosive material charging in a borehole.

FIG. 11 illustrates a flowchart showing an exemplary method of explosive material charging in a borehole by means of a blasting system. The method comprises a first step 111 starting the method. A second step 112 comprises that the opening step is configured to split or break a splitable cover member by means of a charging hose nozzle of the charging hose in motion. A third step 113 comprises the step of removing the charging hose comprises withdrawing of the charging hose from the openable cover device. A fourth step 114 comprises that the step of pushing the detonator support is preceded by a step that the charging hose enters and pass a backflow prevention valve and subsequently abuts a splitable cover member of the openable cover device for providing said pushing. A fifth step 115 comprises that the step of stopping the detonator support device and the step of opening the openable cover device being performed simultaneously, wherein the splitable cover member splits or breaks by the charging hose (i.e. by the charging hose nozzle) being moved further upward. A sixth step 116 comprises stop moving the charging hose. A seventh step 117 comprises discharging of explosive material from the charging hose nozzle into the borehole above the main body of the detonator support. An eight step 118 comprises stopping the discharge of explosive material. A ninth step 119 comprises withdrawal of the charging hose from the borehole. A tenth step 120 comprises stopping the method.

Alternatively, the operating procedure may be as follows; the operator places the detonator unit in the predefined location in the main body and sets a pre-determined length of the line assembly.

Subsequently, the operator may position the main body onto the charging hose nozzle of the charging hose.

Then the line arrangement is tensioned and since the strength of line arrangement is stronger than that of the splitable cover member, against which the charging hose nozzle abuts when pushing the main body upward, the charging hose nozzle will split or remove the splitable cover member from the main body.

The charging hose nozzle is preferably moved further upward into the borehole, whereby the splitable cover member breaks apart in several small pieces. These parts are preferably small enough, so they do not create any clogging or stopping of the charging process.

The inventor of the present disclosure makes use of the fact that the water pressure applied to the explosive material from above tends to form water streams streaming along the borehole wall of the borehole.

Alternatively, the resilient member arranged on the outer peripheral surface of the main body comprises at least one open space through which the water stream streaming along the borehole wall will drain.

In such way is achieved that the main body not will be pushed out from the borehole.

Additionally, since the water makes water streams flowing along the borehole wall, the explosive will also gain some further adhesion to the borehole wall. This adhesion takes away some of the load of the main body in engagement with the borehole wall.

The explosive material at the vicinity of the detonator support device is under pressure by its own weight. The explosive is a hydrophobic material due to oil content and the water will flow toward the lowest pressure point, which is at the at least one open space of the resilient member of the detonator support device.

Figure 12:
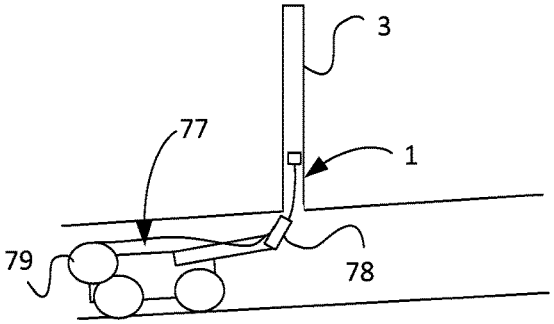
FIG. 12 illustrates an explosive material charging vehicle configured to perform an exemplary method of explosive material charging in a borehole.

FIG. 12 illustrates an explosive material charging vehicle 77 configured to perform an exemplary method of explosive material charging in a borehole 3. The explosive material charging vehicle 77 comprises a robotic arm 78 and a charging hose feeder 79, which are coupled to a control circuitry (not shown, reference 50, see FIG. 13) of the explosive material charging vehicle 77. The control circuitry is configured to control the exemplary method or methods as disclosed herein. The control circuitry comprises a data medium, configured for storing a data program, configured for controlling the blasting system 1 of the explosive material charging vehicle 77. The data medium comprises a program code stored on the data medium, which program code is readable on the control circuitry for performing the method steps.

Figure 13:
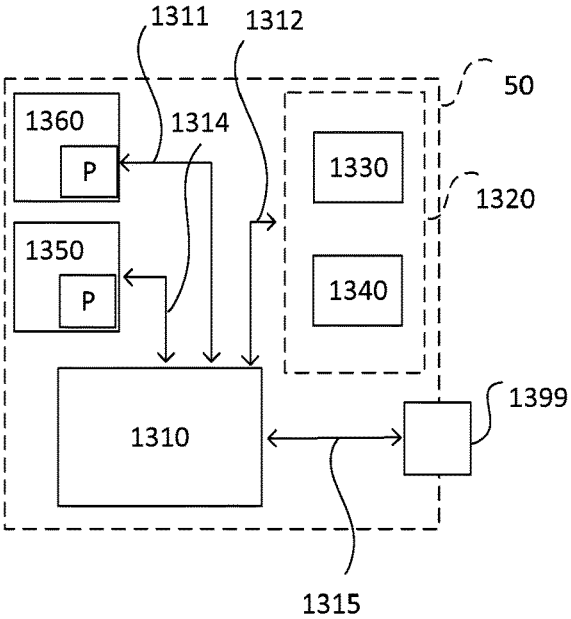
FIG. 13 illustrates a control circuitry adapted to operate an explosive material charging vehicle configured to perform an exemplary method of explosive material charging in a borehole.

FIG. 13 illustrates a control circuitry 50 adapted to operate an explosive material charging vehicle (e.g. shown in FIG. 12) configured to perform an exemplary method of explosive material charging in a borehole. The control circuitry 50 is coupled to an actuator arrangement (not shown) of a robotic arm (not shown) of the explosive material charging vehicle. The control circuitry 50 is configured to perform the method of explosive material charging in a borehole by means of a blasting system comprising a detonator support device configured to be inserted into the borehole by means of a charging hose; a main body of the detonator support device comprises a channel oriented along a main body centre line extending along the borehole extension during said explosive material charging; an openable cover device covering the channel is configured to come into contact with the charging hose in motion for pushing the main body along the borehole, wherein the charging hose in motion is configured to open the openable cover device whilst a stopping arrangement stops the main body. The method comprises providing the detonator support device coupled to the stopping arrangement and preparing a detonator unit to be coupled to a detonation cord member. It further comprises mounting the detonator unit to the detonator support device and successively inserting the detonator support device into the borehole. The method comprises pushing the detonator support device by the charging hose, stopping the detonator support device by means of the stopping arrangement; opening the openable cover device by further motion of the charging hose; charging the explosive material into the borehole; and removing the charging hose.

The control circuitry 50 may also be configured for manoeuvring the explosive material charging vehicle in the crosscut of the mine (not shown).

The control circuitry 50 may comprise a computer and a non-volatile memory NVM 1320, which is a computer memory that can retain stored information even when the computer is not powered.

The control circuitry 50 further comprises a processing unit 1310 and a read/write memory 1350. The NVM 1320 comprises a first memory unit 1330. A computer program (which can be of any type suitable for any operational data) is stored in the first memory unit 1330 for controlling the functionality of the control circuitry 5. Furthermore, the control circuitry 50 comprises a bus controller (not shown), a serial communication unit (not shown) providing a physical interface, through which information transfers separately in two directions.

The control circuitry 50 may comprise any suitable type of I/O module (not shown) providing input/output signal transfer, an A/D converter (not shown) for converting continuously varying signals from a sensor arrangement (not shown) of the control circuitry 50 configured to determine the actual position of the robotic arm and the charging hose. The control circuitry 50 is configured to, from received control signals, define actual positions of the robotic arm and operation of the explosive material charging vehicle into binary code suitable for the computer, and from other operational data.

The control circuitry 50 also comprises an input/output unit (not shown) for adaptation to time and date. The control circuitry 50 comprises an event counter (not shown) for counting the number of event multiples that occur from independent events in operation of the explosive material charging vehicle.

Furthermore, the control circuitry 50 includes interrupt units (not shown) associated with the computer for providing a multi-tasking performance and real time computing for semi-automatically and/or autonomous maneuvering the explosive material charging vehicle. The NVM 1320 also includes a second memory unit 1340 for external sensor check of the sensor arrangement.

A data medium for storing a program P may comprise program routines for automatically adapting the maneuvering of the explosive material charging vehicle in accordance with operational data of co-operative explosive material charging vehicles (not shown).

The data medium for storing the program P comprises a program code stored on a medium, which is readable on the computer, for causing the control circuitry 50 to perform the method and/or method steps described herein.

The program P further may be stored in a separate memory 1360 and/or in the read/write memory 1350. The program P, in this embodiment, is stored in executable or compressed data format.

It is to be understood that when the processing unit 1310 is described to execute a specific function that involves that the processing unit 1310 may execute a certain part of the program stored in the separate memory 1360 or a certain part of the program stored in the read/write memory 1350.

The processing unit 1310 is associated with a data port 999 for communication via a first data bus 1315 able to be coupled to the robotic arm and the charging hose feeder 79 for performing said method steps.

The non-volatile memory NVM 1320 is adapted for communication with the processing unit 1310 via a second data bus 1312. The separate memory 1360 is adapted for communication with the processing unit 610 via a third data bus 1311. The read/write memory 1350 is adapted to communicate with the processing unit 1310 via a fourth data bus 1314. After that the received data is temporary stored, the processing unit 1310 will be ready to execute the program code, according to the above-mentioned method.

Preferably, the signals (received by the data port 999) comprise information about operational status of the explosive material charging vehicle. The received signals at the data port 999 can be used by the control circuitry 50 for controlling and monitoring automatic calibration of the sensor device 1.

Information and data may be manually fed, by an operator, to the control circuitry via a suitable communication device, such as a computer display or a touchscreen.

The method can also partially be executed by the control circuitry 50 by means of the processing unit 1310, which processing unit 1310 runs the program P being stored in the separate memory 1360 or the read/write memory 1350. When the control circuitry 50 runs the program P, the suitable method steps disclosed herein will be executed.

Alternatively, the charging hose in motion is configured to open the openable cover device whilst a stopping arrangement (not shown) of the robotic arm stops the main body.

Figure 14B:
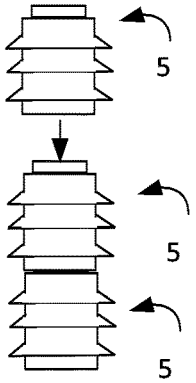
FIG. 14*b* illustrates stackable detonator support devices.
Figure 14A:
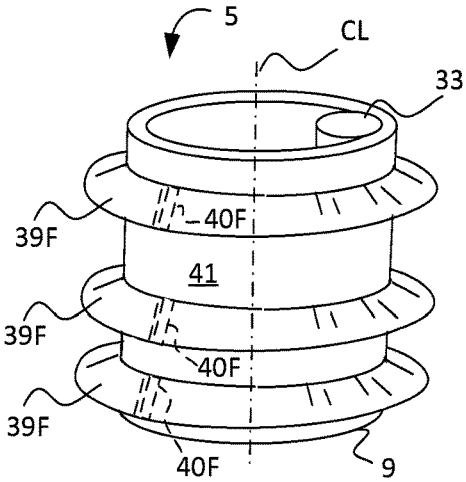
FIG. 14*a* illustrates an exemplary detonator support of a blasting system in perspective view.

FIG. 14*a* illustrates an exemplary detonator support 5 of a blasting system in perspective view.

A main body 9 of the detonator support 5 comprises a resilient flange 39F extending circumferentially around the main body 9 and is arranged to an outer peripheral surface 41 of the main body 9 and around the main body centre axis CL. A detonator unit compartment 33 is provided in the main body 9, which detonator unit compartment 33 being adjacent a side wall of the detonator support 5. The main body 9 of the detonator support 5 comprises a resilient flange arrangement having three rows of resilient flanges 39F. Each resilient flange 39F extend circumferentially around the main body 9 and is arranged to an outer peripheral surface 41 of the main body 9 and around the main body centre axis CL. The resilient flanges 39F extend continuously around the main body 9 and are adapted to engage the borehole wall (not shown) of a borehole (not shown). The resilient flanges 39F are biased toward the borehole wall for holding the detonator support 5 in rigid position in the borehole.

The water pressure built up above the main body 9 does not have sufficient force to move the detonator support 5 in the borehole due to the resilient flanges 39F biased toward the borehole wall. The spring biasing resilient flanges 39F hold the main body 9 in position in the borehole and the water pressure does not press out the main body 9 from the borehole, thus eliminating the risk of releasing explosive material from the borehole.

The resilient flanges 39F generate sufficient friction resisting action of the main body relative the borehole. In such way the detonator support 5 is prevented from being "ejected" from the borehole, due to gravity and the weight/pressure of explosive material and water.

The resilient flanges 39F are made of flexible material (e.g. plastic).

Alternatively, each resilient flange 39F may comprise at least one slot 40F (dotted lines). Such set of slots 40F may be used to guide a detonation cord (not shown) outside the main body 9.

FIG. 14*b* illustrates detonator supports 5 that are stacked on one another. The number of stacked detonator supports 5 may depend on desired resisting force of the stack for holding the stack in position preventing water and explosive material. A detonator unit may be positioned in each end of the stack or in each detonator support. The detonator units may be coupled to each other via a detonator cord (not shown).

An upper part (during use of the stack) of the detonator supports 5 may comprise a protrusion or a depression and a lower part of the detonator supports 5 may comprise a depression or a protrusion, which depression and protrusion mate with each other for joining adjacent detonator supports 5 to each other.

The present invention is of course not in any way restricted to the preferred embodiments described above, but many possibilities to modifications, or combinations of the described embodiments thereof should be apparent to a person with ordinary skill in the art without departing from the basic idea of the invention as defined in the appended claims.

The invention claimed is:

1. A blasting system configured for explosive material charging in a borehole; the system comprising:

a charging hose;

a detonator support device configured to be inserted into the borehole by the charging hose;

a main body of the detonator support device comprises a channel oriented along a main body center line (CL) extending along the borehole during said explosive material charging;

the detonator support device comprises an openable cover device covering the channel is configured to come into contact with the charging hose in motion for pushing the main body along the borehole, a stop having a dimension larger than a diameter of the borehole, the stop coupled to the detonator support device; and the charging hose in motion is configured to open the openable cover device whilst the stop is configured to stop the main body.

2. The blasting system according to claim 1, wherein the openable cover device is configured to be opened by the free end of a charging hose nozzle of the charging hose being in motion whilst the main body is configured to be stopped at a pre-determined distance from the borehole entrance of the borehole.

3. The blasting system according to claim 1, wherein the openable cover device further comprises a backflow prevention valve device configured to prevent discharged explosive material discharged from the charging hose to flow back into and/or passing through the channel when the charging hose has been removed from the channel.

4. The blasting system according to claim 1, wherein a detonator unit compartment is provided in the main body adjacent the channel and configured to support a detonator unit.

5. The blasting system according to claim 1, wherein the main body comprises a resilient member extending circumferentially around the main body and is arranged to an outer peripheral surface of the main body and around the main body center line (CL).

6. The blasting system according to claim 5, wherein the resilient member comprises at least one open space configured to permit water to pass.

7. A detonator support device configured for supporting a detonator unit and configured for explosive material charging in a borehole, the detonator support device comprises a charging hose, a stop, a main body having a channel oriented along a main body center line (CL) and comprises an openable cover device covering the channel in closed state;

the openable cover device is configured to come into contact with the charging hose in motion for pushing the main body;

the stop having a dimension larger than a diameter of the borehole is coupled to the detonator support device; and the charging hose in motion is configured to open the openable cover device whilst the stop is configured to stop the main body.

8. A method of explosive material charging in a borehole by a blasting system comprising a detonator support device configured to be inserted into the borehole by a charging hose; a main body of the detonator support device comprises a channel oriented along a main body center line (CL) extending along the borehole during said explosive material charging; an openable cover device covering the channel is configured to come into contact with the charging hose in motion for pushing the main body along the borehole, wherein the charging hose in motion is configured to open the openable cover device whilst a stop having a dimension larger than a diameter of the borehole stops the main body; the method comprising:

providing the detonator support device coupled to the stop;

preparing a detonator unit to be coupled to a detonation cord member;

mounting the detonator unit to the detonator support device;

inserting the detonator support device into the borehole;

pushing the detonator support device by the charging hose;

stopping the detonator support device by the stop;

opening the openable cover device by further motion of the charging hose;

charging the explosive material into the borehole; and removing the charging hose.

9. The method according to claim 8, wherein the openable cover device in said opening step is configured to split or break by a charging hose nozzle of the charging hose in motion.

10. The method according to claim 8, wherein removing the charging hose comprises withdrawing of the charging hose from the openable cover device.

11. The method according to claim 8, wherein pushing the detonator support device is preceded by that the charging hose enters the main body and subsequently abuts a splitable cover member of the openable cover device for providing said pushing.

12. The method according to claim 11, wherein stopping the detonator support device and opening the openable cover device are performed simultaneously, wherein the splitable cover member splits or breaks by the charging hose.

13. An autonomous or semi-automatic explosive material charging vehicle, which comprises a robotic arm and a charging hose feeder, which are coupled to a control circuitry of the explosive material charging vehicle, wherein the control circuitry is coupled to an actuator arrangement of the robotic arm and is configured to perform a method of said explosive material charging in a borehole by said blasting system according to claim 1;

the control circuitry comprises an I/O module providing input/output signal transfer, an A/D converter for converting continuously varying signals from a sensor arrangement of the control circuitry configured to determine an actual position of the robotic arm and a charging hose, the control circuitry is further configured to, from received control signals and from other operational data, define actual positions of the robotic arm and operation of the explosive material charging vehicle into binary code suitable for a computer; and the control circuitry is configured to control the method according to claim 8.

14. A data medium, configured for storing a program (P) for controlling the explosive material charging vehicle according to claim 13 to perform the method of claim 8 in a blasting system according to claim 1, wherein said data medium comprises a program code stored on the data medium, which program code is readable by the control circuitry for performing the method steps according to claim 8.

15. A data medium product comprising a program code stored on a data medium, which program code is readable by the control circuitry for performing the method steps according to claim 8, when the data medium according to claim 14 is run on the control circuitry.

* * * * *